US005760289A

United States Patent [19]

Skottegard

[11] Patent Number: 5,760,289

[45] Date of Patent: Jun. 2, 1998

[54] SYSTEM FOR BALANCING LOADS ON A THRUST BEARING OF A GAS TURBINE ENGINE ROTOR AND PROCESS FOR CALIBRATING CONTROL THEREFOR

[75] Inventor: Peter N. Skottegard, West Chester, Ohio

[73] Assignee: General Electric Company, Cincinnati, Ohio

[21] Appl. No.: 581,784

[22] Filed: Jan. 2, 1996

[51] Int. Cl.[6] ..... G01L 25/00

[52] U.S. Cl. ..... 73/1.08; 415/20; 415/104; 364/571.05; 701/100

[58] Field of Search ..... 73/1.08, 1.15, 73/1.14, 1.01; 415/20, 104; 364/571.01–571.08, 508, 431.02; 701/100

[56] References Cited

U.S. PATENT DOCUMENTS

| | | | |
|---|---|---|---|
| 3,763,700 | 10/1973 | MacDonald | 73/862.49 |
| 4,159,888 | 7/1979 | Thompson | 415/105 |
| 4,268,220 | 5/1981 | Malott | 415/104 |
| 4,306,834 | 12/1981 | Lee | 415/116 |
| 4,578,018 | 3/1986 | Pope | 415/104 X |
| 4,643,592 | 2/1987 | Lewis et al. | 384/99 X |
| 4,697,981 | 10/1987 | Brown et al. | 415/104 |
| 4,831,534 | 5/1989 | Blotenberg | 364/571.07 X |
| 4,836,693 | 6/1989 | Stroze | 384/448 X |
| 4,864,810 | 9/1989 | Hines | 60/39.05 |
| 4,915,510 | 4/1990 | Ardvidsson | 384/99 |
| 5,076,755 | 12/1991 | Okada | 415/34 X |
| 5,099,966 | 3/1992 | Wohrl | 384/448 X |
| 5,110,257 | 5/1992 | Hibner et al. | 415/119 |
| 5,221,146 | 6/1993 | Maruyama | 384/448 X |
| 5,397,183 | 3/1995 | Lu et al. | 384/448 X |

*Primary Examiner*—Thomas P. Noland

*Attorney, Agent, or Firm*—Andrew C. Hess; Patrick R. Scanlon

[57] ABSTRACT

A process for periodically calibrating an algorithm in a control unit of a system for balancing loads on a thrust bearing of a gas turbine engine rotor is disclosed involving the steps of initializing a calibration of the control unit algorithm, causing the engine to attain a crossover condition, measuring the residual load on the rotor thrust bearing, calculating a residual load on the rotor thrust bearing by means of the control unit algorithm, comparing the measured residual load and the calculated residual load on the rotor thrust bearing to determine a difference therebetween, and modifying the control unit algorithm to compensate for the difference between the measured and calculated residual loads on the rotor thrust bearing.

15 Claims, 4 Drawing Sheets

SYSTEM FOR BALANCING LOADS ON A THRUST BEARING OF A GAS TURBINE ENGINE ROTOR AND PROCESS FOR CALIBRATING CONTROL THEREFOR

BACKGROUND OF THE INVENTION

1. Field of the Invention

The present invention relates to a system for balancing loads on a thrust bearing of a gas turbine engine rotor and, more particularly, a process for calibrating an algorithm in the control unit for such balance system.

2. Description of Related Art

One characteristic of a turbine engine is that it includes rotating components which generate forces that affect and are absorbed by stationary components which carry such rotating components. For example, a rotor in modem gas turbine engines comprises a variety of members such as shafts, shaft cones, discs or drums carrying blades, fluid seals, and various connecting structural members. At different points or portions in the engine, depending upon the relative pressure, thrust forces in the engine act axially on the engine. Since gas stream or fluid flow path pressures decrease axially downstream on the engine, the net axial force in the turbine portion of the engine is downstream. It will be understood that a compressor driven by a turbine can, to a certain extent, compensate for such net axial downstream force in the turbine. This is because the highest pressure in the compressor is in its latter stages and tends to exert a net axial forward force. However, in a free-wheeling power turbine, axial downstream force is absorbed by a thrust bearing or complex arrangement of bearings.

Since it is desirable to limit the amount of load or axial force on the thrust bearing in order to prolong the life of that component, the net load thereon is offset by a balance system. One such system involves a balance piston cavity connected to a rotor shaft which is located in the rear frame of the engine opposite the rotor thrust bearing positioned at the upstream end of the rotor shaft in the compressor section of the engine. Pressurized air is supplied to the balance piston cavity in order to generate a forward force on the rotor shaft and offset the loads on the rotor thrust bearing. Because the net load on the rotor thrust bearing cannot be measured directly, it is instead inferred by correlations with measurements of instrumented engine parameters. Thus, the pressure of the balance piston cavity is modified according to a complex algorithm contained in an active control unit which controls the flow of air from high pressure compressor interstage bleeds to the balance piston cavity.

It will be understood that while processes have been developed for testing the balance piston system and its associated control unit during production so that the complex algorithm is properly calibrated, there is no such process or system in place for the complex algorithm to be recalibrated in the field once the engine has undergone changes caused by deterioration, wear, or replacement of parts. Each of these factors has a direct effect on engine components which influence the load on the rotor thrust bearing and, correspondingly, to the amount of pressure required in the balance piston cavity to offset such loads. Accordingly, it would be highly desirable for a process to be developed in which the algorithm in the control unit could be calibrated, either automatically or through manual input, while the engine is operating in the field. Further, it would also be desirable if this calibration process could be performed during normal engine operation without the need for shutdown.

SUMMARY OF THE INVENTION

In accordance with one aspect of the present invention, a process for periodically calibrating an algorithm in a control unit of a system for balancing loads on a thrust bearing for a gas turbine engine rotor is disclosed. This calibration process involves the steps of initializing a calibration of the control unit algorithm, causing the engine to attain a cross-over condition, measuring the residual load on the rotor thrust bearing, calculating a residual load on the rotor thrust bearing by means of the control unit algorithm, comparing the measured residual load and the calculated residual load on the rotor thrust bearing to determine a difference therebetween, and modifying the control unit algorithm to compensate for the difference between the measured and calculated residual loads on the rotor thrust bearing.

In a second aspect of the present invention, a system for balancing loads on a thrust bearing for a gas turbine engine rotor is disclosed including a balance piston cavity of specified area located in a rear frame of the engine, the balance piston cavity being connected to the rotor shaft opposite the rotor thrust bearing positioned at an upstream end of the rotor shaft, means for supplying pressurized air to the balance piston cavity so that a target pressure is generated therein and a forward force is applied thereby to the rotor shaft to provide ideal loading on the rotor thrust bearing, and a control unit including an algorithm for maintaining the target pressure in the balance piston cavity by controlling the flow of air supplied thereto, where the algorithm is calibrated periodically to provide a revised target pressure in the balance piston cavity.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
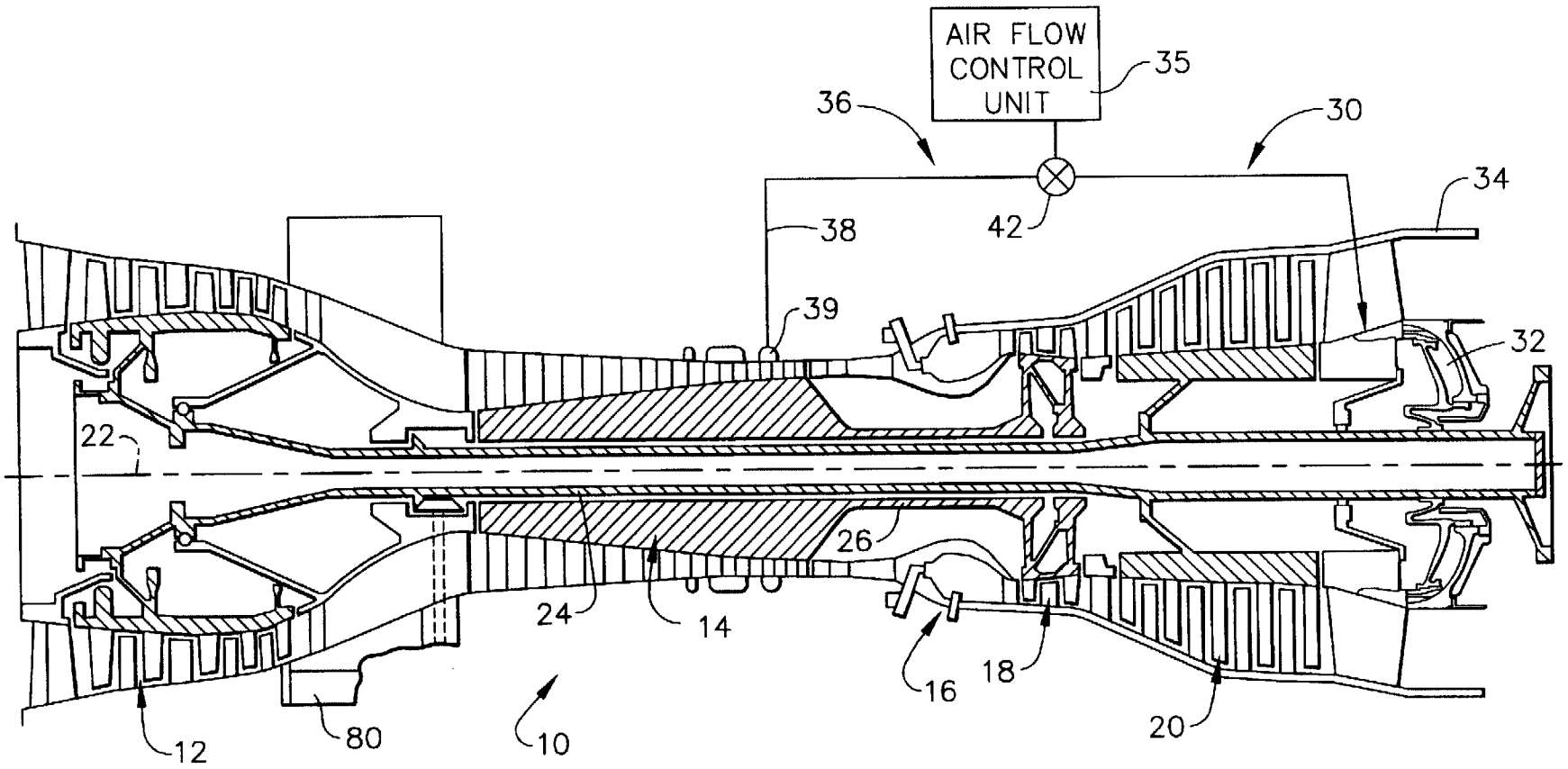
FIG. 1 is a longitudinal cross-sectional view of a gas turbine engine including a rotor thrust bearing and a balance piston system for balancing loads thereon.

Referring now to the drawings in detail, wherein identical numerals indicate the same elements throughout the figures, FIG. 1 depicts an aeroderivative gas turbine engine 10 of the type having a low pressure compressor 12, a high pressure compressor 14 downstream of low pressure compressor 12, a combustor 16 downstream of high pressure compressor 14, a high pressure turbine 18 downstream of combustor 16, and a low pressure turbine 20 downstream of high pressure turbine 18. The elements of gas turbine engine 10 rotate about a longitudinal axis 22. The standard configuration for engines of this type is a dual concentric shafting arrangement, whereby low pressure turbine 20 is drivingly connected to low pressure compressor 12 by a shaft 24 and high pressure turbine 18 is similarly drivingly connected to high pressure compressor 14 by a second shaft 26 internal and concentric to shaft 24. In the gas turbine engine depicted in FIG. 1, low pressure turbine 20 is connected directly to low pressure compressor 12 and a load at a downstream end (not shown). An example of such an engine is manufactured by General Electric Company of Evandale, Ohio under the designation LM6000.

As discussed above, certain thrust forces are produced within gas turbine engine 10 which act axially at different points or portions in engine 10. While a compressor driven by a turbine can compensate to some degree for a net axially downstream force in the turbine (such as the case with low pressure compressor 12 and low pressure turbine 20), a rotor thrust bearing, as designated generally by the numeral 28, is normally required in order to fully absorb the thrust forces produced by low pressure turbine 20. In order to limit the amount of net axial force imposed on rotor thrust bearing 28, a system generally indicated by the numeral 30 is utilized to balance such thrust loads thereon. For example, low pressure turbine 20 of engine 10 may generate 60,000 pounds of thrust and rotor thrust bearing 28 may be able to sustain approximately 7,000 pounds of load. In order to allow for an appropriate safety factor, the axial forces generated by low pressure compressor 12 and balance system 30 must adequately counter such turbine thrust loads.

Figure 2:
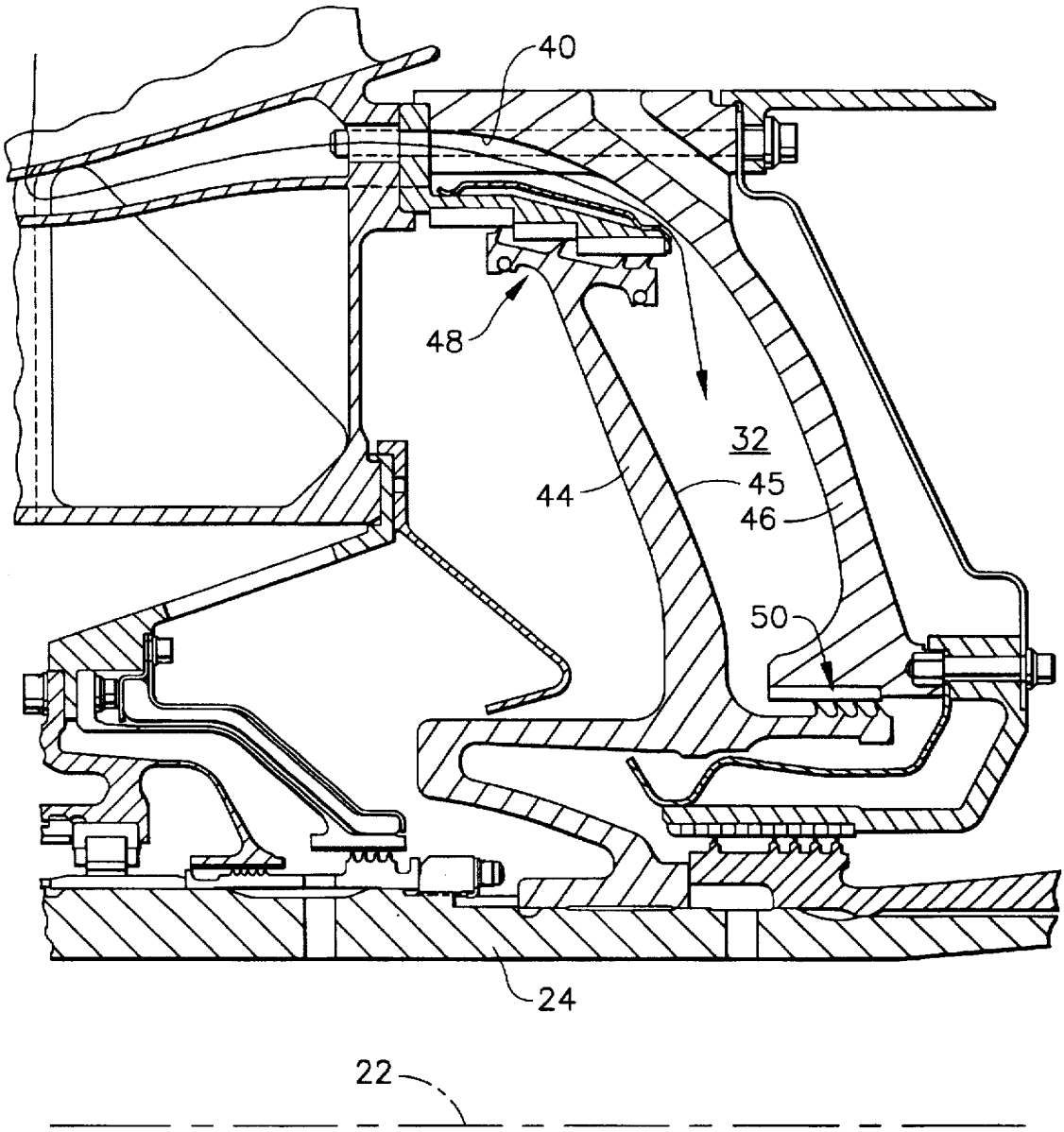
FIG. 2 is an enlarged, partial cross-sectional view of the balance piston cavity depicted in FIG. 1.

It will be seen from FIGS. 1 and 2 that balance system 30 includes a balance piston cavity 32 of specified area located in a rear frame 34 of engine 10, means 36 for supplying pressurized air to balance piston cavity 32, and a control unit 35 which is utilized to control the flow of air to balance piston cavity 32 and maintain a desired pressure therein. More specifically, it will be seen that means 36 for supplying pressurized air consists of an air line 38 from an interstage bleed 39 of high pressure compressor 14, a passage 40 in rear frame 34 (see FIG. 2) in flow communication with air line 38 at one end and balance piston cavity 32 at a second end, and a valve 42 interposed in air line 38 controlled by control unit 35.

It will be seen from FIG. 2 that the construction of balance piston cavity 32 is well known in the art and made up of a first member 44 which extends generally radially from low pressure shaft 24 to rear frame 34, and a second member 46 located downstream of first member 44. Labyrinth seals 48 and 50 are associated with first member 44 in order to maintain a controlled air pressure within balance piston cavity 32. Accordingly, it will be understood that the air pressure within balance piston cavity 32 (generally approximately 100 p.s.i.) is exerted against a surface 45 of first member 44 in an upstream direction which, in turn, exerts a like upstream force on low pressure shaft 24. It is this upstream load on low pressure shaft 24, in conjunction with the thrust forces of low pressure compressor 12, which balances the load on rotor thrust bearing 28.

Figure 3:
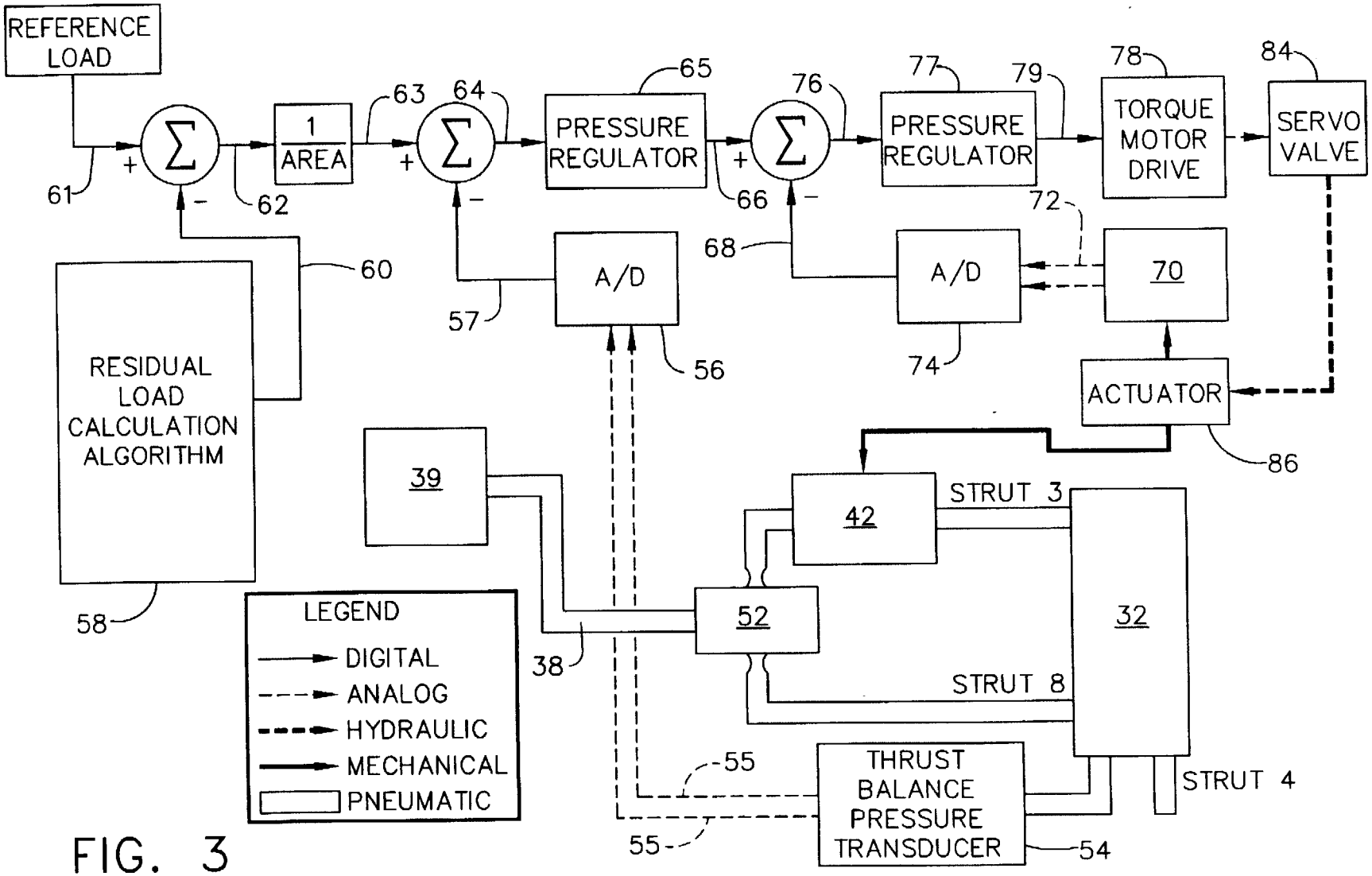
FIG. 3 is a block diagram of the system for balancing loads on the rotor thrust bearing depicted in FIGS. 1 and 2.

Balance system 30 is also seen in block form in FIG. 3. It will be noted that air line 38 provides pressurized air flow into balance piston cavity 32 from interstage bleed 39, the air flow first entering a junction block 52 which splits the air flow between passages in struts 3 and 8 of rear frame 34. Most of the air flow will be understood to flow through passage 40 in strut 3 (see FIG. 2), with thrust balance valve 42 being located between junction block 52 and passage 40. Thrust balance valve 42 is utilized to limit the amount of pressurized air flow into balance piston cavity 32 and is controlled by control unit 35. Thrust balance pressure transducers 54 are positioned within balance piston cavity 32 in order to continuously monitor the pressure in balance piston cavity 32. Analog signals 55 from thrust balance pressure transducers 54 are converted into a digital signal 57 by a signal processor 56, digital signal 57 representing an actual balance piston cavity pressure measured therein. For back up purposes, a pressure monitor may also be provided in one of the other struts of rear frame 34, such as strut 4.

Control unit 35 actively controls the position of thrust balance valve 42 in response to an algorithm 58 which continuosly calculates the residual load 60 on rotor thrust bearing 28 through certain measured parameters. Calculated residual load 60 is subtracted from a desired net load or reference load 61 to determine a calculated balance load 62 required from balance piston cavity 32. Reference load 61 is that amount of load or force which is able to be maintained on rotor thust bearing 28 (approximately 7,000 pounds aft) in order to protect against the risk factors of rotor dynamics and skidding and still permit acceptable wear life. During a balanced condition, calculated residual load 60 on rotor thrust bearing 28 fluctuates, but the target pressure maintained within balance piston cavity 32 is altered accordingly to maintain reference load 61 within a desired range (±500 pounds). In order for the target pressure in balance piston cavity 32 to be modified, air flow is increased or decreased as necessary by adjusting the position of thrust balance valve 42. As seen in FIG. 3, calculated balance load 62 is divided by the area of balance piston cavity 32 (which is known) in order to derive a calculated or target pressure 63 for balance piston cavity 32.

Subsequently, calculated pressure 63 in balance piston cavity 32 is compared with the actual measured pressure therein (as represented by digital signal 57). The difference therebetween is considered to be an error in the balance piston cavity pressure (represented by a signal 64), which is then input into a pressure regulator 65 to convert it into a valve position 66 for thrust balance valve 42. Calculated valve position 66 is then compared with an actual valve position 68 sensed by a linear variable differential transducer sensor 70, a signal 72 of which has been converted from analog to digital by a signal processor 74. Accordingly, the difference between the calculated valve position 66 for thrust balance valve 42 and the actual valve position 68 thereof is utilized to provide a signal 76 (which is transformed into a signal 79 in milliamps by a pressure regulator 77) to a torque motor driver 78 and a servo valve 84, which causes an actuator 86 to adjust the position of thrust balance valve 42.

To date, algorithm 58 in control unit 35 is calibrated only during the initial production of engine 10 and therefore becomes less accurate as wear on engine 10 increases, component parts are substituted within engine 10, and engine to engine variation in operation becomes more significant. This uncertainty leads to loads on rotor thrust bearing 28 which limit the nominal bearing life thereof unless an additional safety factor is provided. Therefore, it is the intent of the present invention to provide a process for calibrating algorithm 58 in control unit 35 after engine 10 is operating out in the field. In this way, the target pressure of balance piston cavity 32 calculated by control unit 35 is more accurately and consistently maintained.

Figure 4:
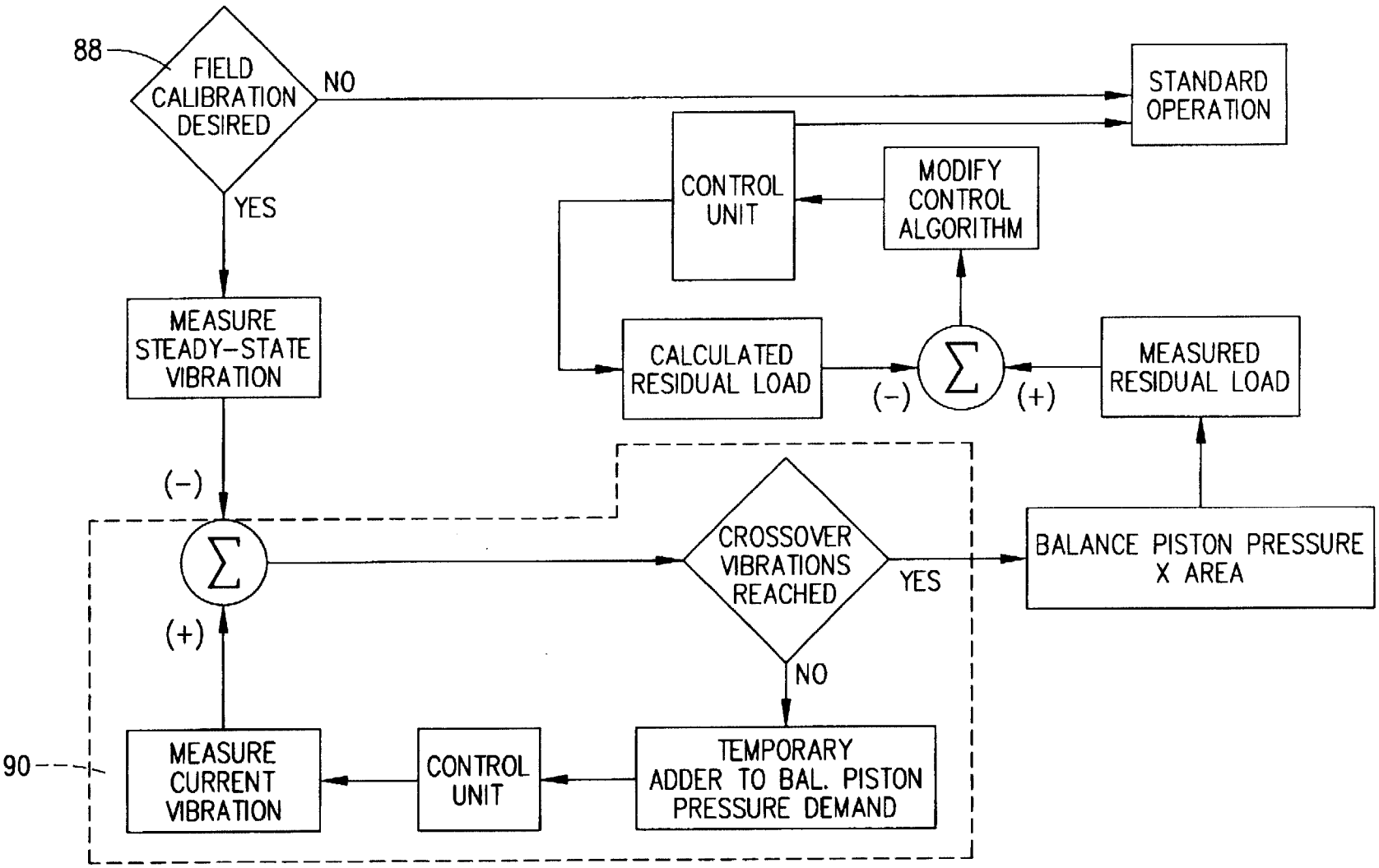
FIG. 4 is a block diagram depicting the process of calibrating an algorithm in the control unit for the balance system depicted in FIG. 3.

FIG. 4 depicts a flow diagram of the process for calibrating algorithm 58 in control unit 35. In this regard, a decision block 88 determines whether a field calibration is desired. Control unit 35 may be interrogated automatically with this question by any number of triggers, including when a certain specified number of operating hours of engine 10 has been reached or whenever engine 10 undergoes maintenance or part replacements. Alternatively, a manual trigger may be implemented by the engine operator. If field calibration is not desired, engine 10 merely continues with its current steady state operation.

Should field calibration of algorithm 58 be desired, however, engine 10 must be placed in a crossover condition. This crossover condition occurs when the residual load placed on rotor thrust bearing 28 is equivalent to the load provided by balance piston cavity 32, or when the net load on rotor thrust bearing 28 is zero. The crossover condition is determined by an accelerometer 80 attached to a front frame 82 of engine 10 (see FIG. 1), which measures vibrations of front frame 82. Control unit 35 first obtains a measurement of the steady state vibration of front frame 82 by means of accelerometer 80. Then, a subroutine loop 90 is enacted to determine when the crossover condition has been reached, as evidenced by a dramatic increase in front frame vibration (approximately five times the amount of vibration during standard operation). If the appropriate increase in front frame vibrations has not been reached, additional pressure to balance piston cavity 32 is demanded of control unit 35 and more air from air line 38 is provided by adjusting the position of thrust balance valve 42. Thereafter, a measurement of the front frame vibrations is again taken and compared with the front frame vibrations during steady state operation of engine 10. The difference between the steady state vibration measurement and the current vibration measurement is compared to a specified amount of vibration change in order to evaluate whether the crossover condition has been reached or not. Subroutine loop 90 continues until the crossover condition has been reached in engine 10.

Once engine 10 is at crossover, the measured residual load is determined as a function of the product of the balance piston cavity pressure and the balance piston cavity area. This measured residual load is compared with a calculated residual load 60 determined by algorithm 58 within control unit 35 (since the net or reference load is zero), which is dependent on a plurality of measured parameters within engine 10. The difference or error between the calculated and measured residual loads at crossover condition is then utilized to modify algorithm 58 within control unit 35. In this way, algorithm 58 utilized by control unit 35 to maintain balance piston cavity 32 at a target pressure is not a static quantity, but is able to change with engine 10 and the conditions therein. Once algorithm 58 is modified, control unit 35 and engine 10 then return to their standard operation with the desired net load on rotor thrust bearing 28 being maintained.

It will be understood that this process of calibrating algorithm 58 within control unit 35, which is utilized for calculating residual load on rotor thrust bearing 28, takes only a few minutes to accomplish and may be done during actual engine operations so that shutdown is not required. As noted above, the calibration process may be totally automatic within control unit 35 so that no manual intervention is necessary for those engines which are located in somewhat isolated areas. In order to track various deterioration effects on engine 10 or the impact of field modifications thereon, each calibration of algorithm 58 may be recorded. Thus, the calibration process of the present invention not only assists in better tailoring the pressure desired within balance piston cavity 32 for a required allowable load on rotor thrust bearing 28, but also may provide information which can be utilized to better adjust or tune engine 10 after certain hours of operation and perhaps better indicate when various maintenance procedures should be undertaken.

Having shown and described the preferred embodiment of the present invention, further adaptations of the balance system and process utilized for calibrating the algorithm of the control unit thereof can be accomplished by appropriate modifications by one of ordinary skill without departing from the scope of the invention.

I claim:

1. A process for calibrating an algorithm in a control unit for a system balancing loads on a thrust bearing of a gas turbine rotor, comprising the following steps:

(a) initializing a calibration of the control unit algorithm;

(b) causing the engine containing said rotor to attain a crossover condition;

(c) measuring a residual load on the rotor thrust bearing;

(d) calculating a residual load on said rotor thrust bearing by means of said control unit algorithm;

(e) comparing the measured residual load and the calculated residual load on said rotor thrust bearing to determine a difference therebetween; and (f) modifying said control unit algorithm to compensate for the difference between the measured and calculated residual loads on said rotor thrust bearing.

2. The calibration process for said control unit algorithm of claim 1, wherein the initializing step occurs automatically at desired intervals of engine operation.

3. The calibration process for said control unit algorithm of claim 1, wherein the initializing step occurs in response to a manual input to said control unit.

4. The calibration process for said control unit algorithm of claim 1, said load balancing system further comprising:

(a) a balance piston cavity of specified area connected to said rotor; and (b) means for supplying pressurized air to said balance piston cavity; wherein pressure within said balance piston cavity generates a load on the rotor counter to said measured residual load imposed thereon.

5. The calibration process for said control unit algorithm of claim 4, wherein said crossover condition is caused by continuously increasing pressure in said balance piston cavity until the load on said rotor thrust bearing from said balance piston cavity is equivalent to said measured residual load.

6. The calibration process for said control unit algorithm of claim 5, wherein said crossover condition is reached when vibrations of a front frame member of said engine increase in magnitude by a specified amount.

7. The calibration process for said control unit algorithm of claim 6, further comprising the step of providing an accelerometer on said front frame member to measure vibrations of said front frame member.

8. The calibration process for said control unit algorithm of claim 4, said pressurized air supply means further comprising:

(a) a bleed from a compressor in said engine;

(b) an air line in flow communication with said bleed at a first end and said balance piston cavity at a second end; and (c) a valve within said air line for limiting air flow therethrough, said valve being controlled by said control unit.

9. The calibration process for said control unit algorithm of claim 4, wherein said balance piston cavity load is substantially equivalent to the balance cavity pressure multiplied by the area of said balance piston cavity.

10. The calibration process for said control unit algorithm of claim 1, wherein a net load on said rotor thrust bearing is zero.

11. The calibration process for said control unit algorithm of claim 1, wherein said process is performed during normal engine operation.

12. The calibration process for said control unit algorithm of claim 5, further comprising the step of restoring said engine to a balanced condition by modifying the pressure in said balance piston cavity to a revised perssure consistent with the calibrated control algorithm.

13. A system for balancing loads on a thrust bearing for a gas turbine engine rotor, comprising:

(a) a balance piston cavity of specified area located in a rear frame of the engine containing said rotor, wherein said balance piston cavity and the rotor thrust bearing are each connected to a rotor shaft;

(b) means for supplying pressurized air to said balance piston cavity, wherein a target pressure is generated therein and a load is applied to said rotor shaft thereby to provide a desired net load on said rotor thrust bearing; and (c) a control unit including an algorithm for maintaining said target pressure in said balance piston cavity by controlling the flow of air supplied thereto, said algorithm being calibrated periodically by putting said engine in a crossover condition, wherein said algorithm is calibrated by an amount correlating to a difference between a residual load on said rotor thrust bearing calculated by said algorithm ad a measured residual load on said rotor thrust bearing.

14. The balance system of claim 13, wherein said algorithm is calibrated automatically at desired intervals of engine operation.

15. The balance system of claim 13, wherein said net load on said rotor thrust bearing is zero.

* * * * *